US011164555B2

(12) United States Patent
Kalinichenko

(10) Patent No.: US 11,164,555 B2
(45) Date of Patent: Nov. 2, 2021

(54) DEVICE FOR GENERATING ACOUSTIC COMPENSATION SIGNALS

(71) Applicant: ASK INDUSTRIES GMBH, Niederwinkling (DE)

(72) Inventor: Victor Kalinichenko, Viechtach (DE)

(73) Assignee: ASK INDUSTRIES GMBH, Niederwinkling (DE)

( * ) Notice: Subject to any disclaimer, the term of this patent is extended or adjusted under 35 U.S.C. 154(b) by 0 days.

(21) Appl. No.: 16/762,552

(22) PCT Filed: Nov. 6, 2018

(86) PCT No.: PCT/EP2018/080326
§ 371 (c)(1),
(2) Date: May 8, 2020

(87) PCT Pub. No.: WO2019/091973
PCT Pub. Date: May 16, 2019

(65) Prior Publication Data

US 2021/0183354 A1 Jun. 17, 2021

(30) Foreign Application Priority Data

Nov. 9, 2017 (DE) ..... 10 2017 219 991.1

(51) Int. Cl.
*G10K 11/178* (2006.01)

(52) U.S. Cl.
CPC .. *G10K 11/17853* (2018.01); *G10K 11/17861* (2018.01); *G10K 11/17881* (2018.01);
(Continued)

(58) Field of Classification Search
CPC ..... G10K 11/17881; G10K 2210/111; G10K 2210/1282; H04R 2410/01
See application file for complete search history.

(56) References Cited

U.S. PATENT DOCUMENTS 10,156,637 B2 * 12/2018 Kim ..... G10K 11/17821
2010/0054490 A1 3/2010 Chowdhury
(Continued)

FOREIGN PATENT DOCUMENTS

DE 19938171 A1 3/2001

OTHER PUBLICATIONS

International Search Report, dated Feb. 13, 2019 by the European Patent Office (EPO), for International Application No. PCT/EP2018/080326.

*Primary Examiner* — Kile O Blair
(74) *Attorney, Agent, or Firm* — Greenblum & Bernstein, P.L.C.

(57) ABSTRACT

A device for generating acoustic compensation signals, which serve to compensate acoustic signals that result from the operation of a motor-vehicle drive unit. The device includes a signal-generating apparatus designed to generate acoustic compensation signals, which serve to compensate acoustic signals that result from the operation of a motor-vehicle drive unit, and a control apparatus, which is associated with the signal-generating apparatus and which is designed to control the operation of the signal-generating apparatus. The device also includes a determination apparatus, which is associated with the control apparatus and which is designed to determine the propagation direction of acoustic signals and to generate direction information describing the determined propagation direction of the acoustic signals. The control apparatus is further designed to control the operation of the signal-generating apparatus on the basis of corresponding direction information.

16 Claims, 1 Drawing Sheet

(52) U.S. Cl.
CPC ..... *G10K 2210/111* (2013.01); *G10K 2210/1282* (2013.01); *G10K 2210/3033* (2013.01)

(56) References Cited

U.S. PATENT DOCUMENTS

| | | | |
|---|---|---|---|
| 2010/0131269 | A1 | 5/2010 | Park et al. |
| 2016/0163303 | A1 | 6/2016 | Benattar et al. |
| 2016/0241947 | A1 | 8/2016 | Degraye et al. |
| 2017/0061953 | A1 | 3/2017 | An et al. |
| 2017/0236507 | A1 | 8/2017 | Benattar et al. |

* cited by examiner

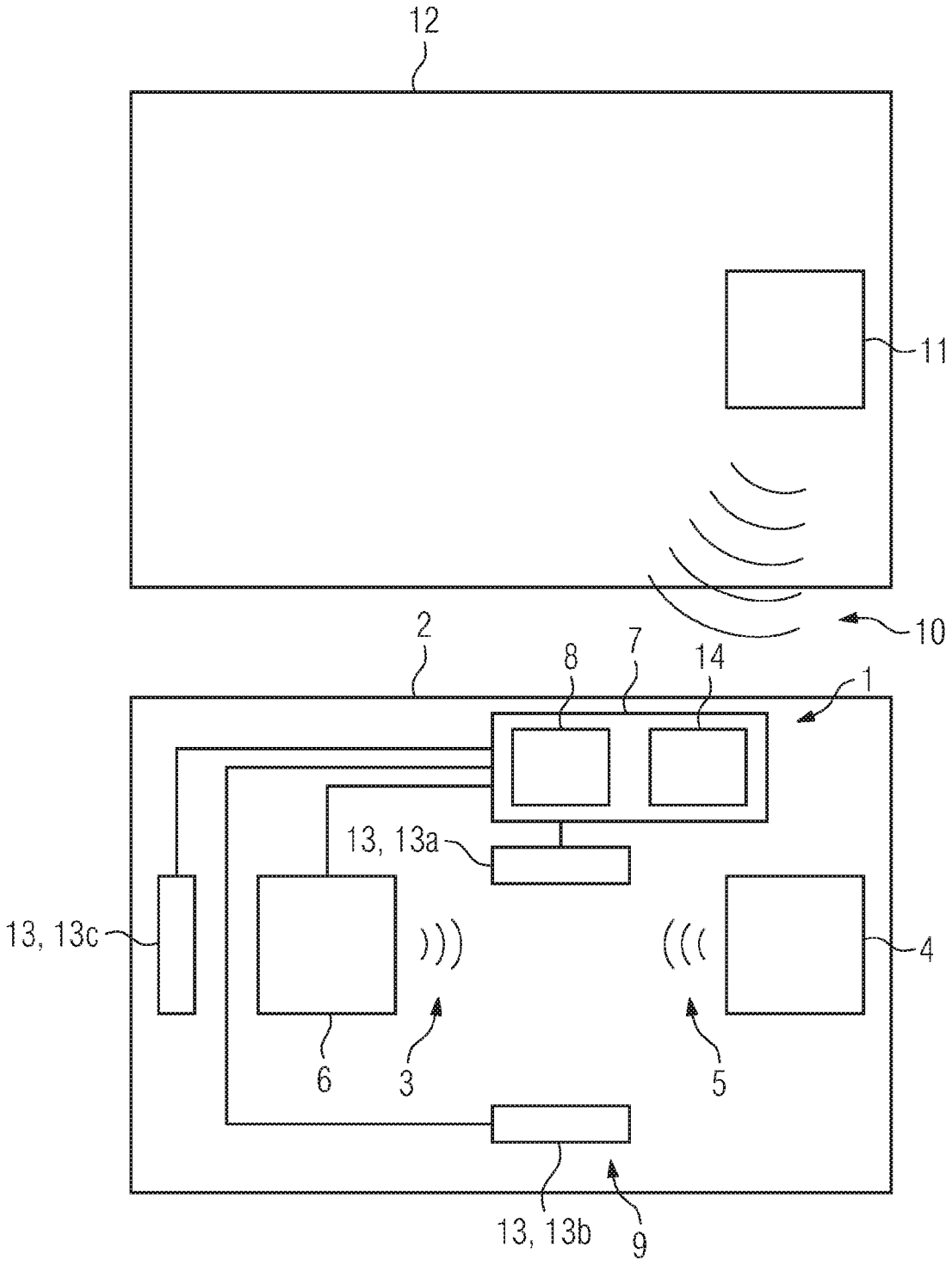
12
11
10
2
8
7
14
1
13, 13a
13, 13c
4
6
3
5
13, 13b
9

DEVICE FOR GENERATING ACOUSTIC COMPENSATION SIGNALS

The invention relates to a device for generating acoustic compensation signals which serve to compensate for acoustic signals that result from the operation of a motor-vehicle drive unit, said device comprising a signal-generating apparatus which is designed to generate acoustic compensation signals which serve to compensate for acoustic signals that result from the operation of a motor-vehicle drive unit and a control apparatus which is associated with the signal-generating apparatus and which is designed to control the operation of the signal-generating apparatus.

Devices of this kind are known per se from the field of motor vehicle audio technology e.g. as engine order cancellation systems (EOC systems). The object and function of corresponding devices consists in generating, in a targeted manner, acoustic compensation signals which serve to compensate for (harmonic) acoustic signals that result from the operation of a motor-vehicle drive unit e.g. on the basis of a frequency inversion. For this purpose, corresponding devices comprise a signal-generating apparatus which is designed to generate corresponding acoustic compensation signals and a control apparatus which is associated with the signal-generating apparatus and which is designed to control the operation of the signal-generating apparatus.

Although known devices in principle allow a reliable compensation of corresponding (harmonic) acoustic signals that result from the operation of motor-vehicle drive units, certain acoustic conditions or influences, e.g. acoustic influences of other road users, e.g. drive units of other motor vehicles, acoustic influences when entering or driving through a tunnel, etc., can lead to artifacts which may be audible to a vehicle occupant and may be perceived as disturbing. This is substantially due to the fact that known devices "cannot recognize" whether an acoustic signal actually results from the operation of the motor-vehicle drive unit. Consequently, compensation signals for compensating for acoustic signals that do not result from the operation of the motor-vehicle drive unit are sometimes also generated, which can lead to corresponding artifacts.

The object of the invention is therefore that of specifying an improved device for generating acoustic compensation signals which serve to compensate for acoustic signals that result from the operation of a motor-vehicle drive unit.

The object is achieved by a device according to claim 1. The claims dependent thereon relate to possible embodiments of the device. The object is further achieved by a method according to claim 15.

The device described herein serves to generate acoustic compensation signals ("compensation signals") which (acoustically) compensate for acoustic signals ("signals") that result from the operation of a motor-vehicle drive unit. The device is therefore designed to generate compensation signals which compensate for signals that result from the operation of a motor-vehicle drive unit. The motor-vehicle drive unit forms the main signal source of the signals to be compensated for by means of the device. A main propagation direction of the signals to be compensated for by means of the device is specified by the defined position of the drive unit in the motor vehicle. The device can be designed as an engine order cancellation system (EOC system) or a functional component of such.

The device comprises a hardware- and software-implemented signal-generating apparatus which is designed to generate acoustic compensation signals which serve to compensate for signals, i.e. typically speed-dependent harmonic signals of a certain order, that result from the operation of a motor-vehicle drive unit, e.g. an internal combustion engine. In order to generate corresponding compensation signals, the signal-generating apparatus typically comprises at least one suitable signal generator element, e.g. a sound generator, and at least one suitable signal output element, e.g. a loudspeaker. The compensation signals can be selected according to their acoustic properties such that said compensation signals allow an acoustic compensation of corresponding signals to be compensated for, e.g. by means of frequency inversion or counter signals (counter noise).

The device further comprises a hardware- and/or software-implemented control apparatus which is associated with the signal-generating apparatus and which is designed to control the operation of the signal-generating apparatus. The control apparatus is therefore designed to generate control information which controls the operation of the signal-generating apparatus. The signal-generating apparatus is therefore operated, i.e. in particular corresponding compensation signals of specific acoustic properties are generated, i.e. in particular of a specific amplitude and frequency or specific amplitude and frequency profiles, on the basis of control information generated by the control apparatus.

The device further comprises a hardware- and/or software-implemented determination apparatus which is associated with the control apparatus and which is designed to determine the propagation direction (sound occurrence direction) of signals (within a motor vehicle equipped with the device, i.e. in particular within the passenger compartment of a motor vehicle equipped with the device) and to generate a piece of direction information describing the determined propagation direction of the signals in question. For this purpose, the determination apparatus can be equipped with suitable evaluation algorithms which allow an evaluation of signals with regard to their propagation direction and therefore a determination of the propagation direction of corresponding signals. The direction information therefore describes the propagation direction of one or more signals (within a motor vehicle equipped with the device, i.e. in particular within the passenger compartment of a motor vehicle equipped with the device). The propagation direction of a particular signal can provide information about whether or not the signal in question results or may result from the operation of the motor-vehicle drive unit—the position of the motor-vehicle drive unit is typically known for this.

As follows below, a determination of the propagation direction of signals may also be understood to mean an in particular direct detection of the propagation direction of signals (within a motor vehicle equipped with the device, i.e. in particular within the passenger compartment of a motor vehicle equipped with the device). If direct detection of the propagation direction of signals is not possible, known principles, in particular from the field of acoustic direction determination, can be used to determine the propagation direction of signals (sound occurrence direction) and (acoustic) localization of signal sources which enables a deduction and derivation of the propagation direction of signals. Corresponding principles for determining the propagation direction of signals are known, for example, by the key term "cocktail party effect."

The control apparatus is designed to control the operation of the signal-generating apparatus on the basis of a piece of corresponding direction information. It is therefore possible to control the operation of the signal-generating apparatus, i.e. in particular the generation of corresponding compensation signals, i.e. in particular to generate corresponding compensation signals, such that the signal-generating apparatus is operated with the proviso that signals are compensated for when their propagation direction indicates that they originate from the region of the motor-vehicle drive unit, i.e. signals which are propagated starting from the motor-vehicle drive unit, and thus actually result from the operation of the motor-vehicle drive unit. Conversely, it is possible to control the operation of the signal-generating apparatus, i.e. in particular the generation of corresponding compensation signals, i.e. in particular to alter, reduce or suppress the generation of corresponding compensation signals, such that the signal-generating apparatus is operated with the proviso that signals are not compensated for when their propagation direction indicates that they do not originate from the region of the motor-vehicle drive unit, i.e. signals which are not propagated starting from the motor-vehicle drive unit, and thus do not result from the operation of the motor-vehicle drive unit. A signal which does not start from a motor-vehicle drive unit of a motor vehicle equipped with the device or a region of a motor vehicle equipped with the device that accommodates a motor-vehicle drive unit can be generated e.g. by a signal source located outside of a motor vehicle equipped with the device. However, it is also conceivable that such a signal starts from a signal source located within the motor vehicle which is formed e.g. by a component which is set in oscillation or vibration, in particular when the motor vehicle is in operation.

The device is therefore designed to determine whether or not an acoustic signal actually results from the operation of the motor-vehicle drive unit. Thus, the device is designed to differentiate between signals which are relevant for their actual function, i.e. the compensation of signals that result from the operation of the motor-vehicle drive unit, and signals which are not relevant for their actual function. The device is operated, i.e. in particular compensation signals are generated, on the basis of this decision such that only relevant signals are compensated for. The device is therefore sensitive to disturbances due to certain acoustic conditions or influences, e.g. acoustic influences of other road users, e.g. drive units of other motor vehicles, acoustic influences when entering or driving through a tunnel, etc., and the connected generation of artifacts which may be audible to a vehicle occupant and may be perceived as disturbing.

The determination apparatus can be designed to determine signals which have a first propagation direction that is relevant for the operation of the device for generating acoustic compensation signals which serve to compensate for acoustic signals that result from the operation of a motor-vehicle drive unit, and to generate a piece of first direction information describing the propagation direction of said signals. The operation of the signal-generating apparatus can therefore be controlled on the basis of pieces of first direction information in order to compensate for signals that actually result from the operation of the motor-vehicle drive unit. The signal-generating apparatus can be designed accordingly to compensate for determined signals which have a propagation direction that is relevant for the operation of the device for generating compensation signals which compensate for signals that result from the operation of a motor-vehicle drive unit.

The determination apparatus can be further designed to determine acoustic signals which have a second propagation direction that is not relevant for the operation of the device for generating acoustic compensation signals which serve to compensate for acoustic signals that result from the operation of a motor-vehicle drive unit, and to generate a piece of second direction information describing the propagation direction of said signals. The operation of the signal-generating apparatus can therefore be controlled on the basis of pieces of second direction information, e.g. can be changed, restricted or prevented so as not to compensate for any signals that do not result from the operation of the motor-vehicle drive unit. In this way, the described formation of artifacts which are perceived as disturbing by vehicle occupants can be reduced. The signal-generating apparatus can be designed accordingly to damp and/or filter determined signals which have a propagation direction that is not relevant for the operation of the device for generating acoustic compensation signals which compensate for signals that result from the operation of a motor-vehicle drive unit.

The device can further comprise a hardware- and/or software-implemented memory apparatus which is associated with the control apparatus and in which a piece of first reference direction information describing the propagation direction of a signal that results from the operation of a motor-vehicle drive unit and/or a piece of second reference direction information describing the propagation direction of a signal that does not result from the operation of a motor-vehicle drive unit is stored. By providing a corresponding memory apparatus which can in principle be any volatile or non-volatile data memory, or pieces of reference direction information which are stored in a corresponding memory apparatus and which describe the propagation direction of signals which result from the operation of a motor-vehicle drive unit or the propagation direction of signals which do not result from the operation of a motor-vehicle drive unit, a comparatively simple determination of signals which have a relevant propagation direction for the operation of the device for generating compensation signals is possible by means of data-related adjusting or comparing pieces of determined direction information with corresponding reference direction information. Pieces of corresponding reference direction information can e.g. be generated in the context of a calibration of the device and correspondingly stored in the memory apparatus for the purpose of pieces of calibration information.

The control apparatus can therefore be designed to put the signal-generating apparatus into operation when the direction information, in particular a comparison of the direction information with the reference direction information, describes a propagation direction of a signal starting from the motor-vehicle drive unit or a region of a motor vehicle equipped with the device that accommodates a drive unit. The control apparatus can therefore be designed to operate the signal-generating apparatus such that a compensation signal is generated only for such signals for which a piece of associated direction information describes that said signals have a propagation direction starting from the motor-vehicle drive unit or the region of the motor vehicle equipped with the device that accommodates a motor-vehicle drive unit, which compensation signal compensates for said signals.

Furthermore, the control apparatus can be designed to not put the signal-generating apparatus into operation or to take said signal-generating apparatus out of operation or to put said signal-generating apparatus into operation using at least one other set of operating parameters when the direction information, in particular a comparison of the direction information with the reference direction information, describes a propagation direction of a signal starting from a region other than a region of a motor vehicle that accommodates a drive unit. The control apparatus can therefore be designed to operate the signal-generating apparatus such that a compensation signal is not generated for such signals for which a piece of associated direction information describes that said signals do not have a propagation direction starting from a motor-vehicle drive unit or a region of a motor vehicle that accommodates a motor-vehicle drive unit, which compensation signal compensates for said signals.

The control apparatus can (therefore) be designed to put the signal-generating apparatus into operation such that an acoustic compensation signal is not generated for such acoustic signals for which a piece of associated direction information describes that said signals do not have a propagation direction starting from a motor-vehicle drive unit or a region of a motor vehicle equipped with the device that accommodates a motor-vehicle drive unit, which acoustic compensation signal compensates for said signals. Therefore, acoustic signals for which a piece of associated direction information describes that said signals do not have a propagation direction starting from a motor-vehicle drive unit or a region of a motor vehicle equipped with the device that accommodates a motor-vehicle drive unit can be ignored, in particular completely ignored.

In all of the above-mentioned cases, the above-mentioned formation of artifacts which may be audible to vehicle occupants and which may be perceived as disturbing can be reduced.

The device can comprise a hardware- and/or software-implemented detection apparatus which is associated with the control apparatus and which is designed to detect acoustic signals that result in particular from the operation of a motor-vehicle drive unit. The detection apparatus is typically designed to detect (all) signals within a motor vehicle equipped with the device, i.e. in particular within the passenger compartment of a motor vehicle equipped with the device. The device can be designed, on the basis of determining the propagation direction of detected signals, to compensate for detected signals that do not result from the operation of the motor-vehicle drive unit, in particular from a plurality of detected signals which differ in their propagation direction. The compensation may be preceded by filtering certain signals, e.g. signals that are not to be compensated for.

The detection apparatus can comprise a plurality of, i.e. typically at least three, in particular four or more, detection elements which are arranged or can be arranged, in particular so as to be evenly distributed in relation to one another, in an interior, in particular forming part of a passenger compartment, of a motor vehicle equipped with the device. An exemplary arrangement of corresponding detection elements provides in each case at least one detection element in the region of the driver and front passenger seats and at least one detection element in the region of the back of the motor vehicle. Each of the detection elements can be designed as microphones or comprise such. The microphones are typically direction-independent microphones although direction-dependent microphones are also conceivable.

It has been explained that a determination of the propagation direction of signals may also be understood to mean an in particular direct detection of the propagation direction of signals (within a motor vehicle equipped with the device, i.e. in particular within the passenger compartment of a motor vehicle equipped with the device). In this case, the detection apparatus can comprise a plurality of detection elements in the form of direction-dependent microphones that are arranged or can be arranged, in particular so as to be evenly distributed, in an interior, in particular forming a part of a passenger compartment, of a motor vehicle equipped with the device. Typically, at least one microphone is arranged so as to be oriented such that said microphone detects signals that result from the operation of the motor-vehicle drive unit. A corresponding microphone can accordingly be arranged e.g. so as to be oriented (directly) opposite the drive unit.

The invention also relates to a motor vehicle equipped with a device as described above, i.e. a motor vehicle which comprises at least one device as described above. The motor vehicle can be e.g. a passenger car.

The invention further relates to a method for operating a device, in particular as described, for generating compensation signals which serve to compensate signals that result from the operation of a motor-vehicle drive unit. The method comprises the steps of:

- detecting at least one signal (within a motor vehicle, i.e. in particular within the passenger compartment of a motor vehicle),
- determining the propagation direction of the at least one detected signal,
- generating direction information describing the propagation direction of the at least one detected signal,
- controlling the operation of the signal-generating apparatus on the basis of the generated direction information.

The determination according to the method of the propagation direction of the at least one detected signal and the generating of a piece of direction information describing the propagation direction of the at least one detected signal can (simultaneously) take place in a common step.

All embodiments in connection with the device apply analogously to the motor vehicle and to the method.

The invention is explained again in the drawing based on embodiments. In the drawing:

FIG. 1 is a main illustration of a device according to one embodiment.

FIG. 1 is a main illustration of a device 1 according to one embodiment. The device 1 is installed in a motor vehicle 2. The device 1 can be designed as an engine order cancellation system (EOC system) or form a functional component of such.

The device 1 is thus designed to generate compensation signals 3 which compensate for acoustic signals 5, i.e. typically speed-dependent harmonic signals of a certain order, that result from the operation of motor-vehicle drive unit 4. The motor-vehicle drive unit 4 forms the main signal source of the signals 5 to be compensated by means of the device 1. The defined position of the drive unit 4 in the motor vehicle 2 provides a main propagation direction of the signals 5 to be compensated for by the device 1.

The device 1 comprises a hardware- and/or software-implemented signal-generating apparatus 6 which is designed to generate corresponding acoustic compensation signals 3. In order to generate corresponding compensation signals 3, the signal-generating apparatus 6 typically comprises suitable signal generator elements (not shown), e.g. sound generators, and suitable signal output elements (not shown), e.g. loudspeakers. The compensation signals 3 can be selected according to their acoustic properties such that said compensation signals allow an acoustic compensation of corresponding signals 5 to be compensated for, e.g. by means of frequency inversion or counter signals (counter noise).

The device 1 further comprises a hardware- and/or software-implemented control apparatus 7 which is associated with the signal-generating apparatus 6 and which is designed to control the operation of the signal-generating apparatus 6, i.e. to generate control information controlling the operation of the signal-generating apparatus 6. The signal-generating apparatus 6 is therefore operated, i.e. in particular corresponding compensation signals 3 of specific acoustic properties are generated, i.e. in particular of a specific amplitude and frequency or of specific amplitude and frequency profiles, on the basis of control information generated by the control apparatus 7.

The device 1 further comprises a hardware- and/or software-implemented determination apparatus 8 which is associated with the control apparatus 7 and which is designed to determine the propagation direction (sound occurrence direction) of signals 5 within the motor vehicle 2, i.e. in particular within the passenger compartment 9 of the motor vehicle 2, and to generate a piece of direction information describing the determined propagation direction of the signals 5 in question. For this purpose, the determination apparatus 8 is equipped with suitable evaluation algorithms which allow an evaluation of signals 5 with regard to their propagation direction and therefore a determination of the propagation direction of corresponding signals 5. The direction information accordingly describes the propagation direction of one or more signals 5. The propagation direction of a particular signal can provide information about whether or not the signal 5 in question results or may result from the operation of the motor-vehicle drive unit 4.

The device 1 further comprises a hardware- and/or software-implemented detection apparatus 13 which is associated with the control apparatus 7 and which is designed to detect signals 5, 10 resulting in particular from the operation of the motor-vehicle drive unit 4. The detection apparatus 13 is typically designed to detect (all) signals 5, 10 within the motor vehicle 2, i.e. in particular within the passenger compartment 9 of the motor vehicle 2. The device 1 can be designed, on the basis of determining the propagation direction of the detected signals 5, 10, to compensate for detected signals 10 that do not result from the operation of the motor-vehicle drive unit 4, in particular from a plurality of detected acoustic signals 5, 10 which differ in their propagation direction. The compensation may be preceded by filtering certain signals 10, e.g. signals that are not to be compensated.

The detection apparatus 13 comprises a plurality, i.e. typically at least three, detection elements 13*a*-13*c* which are arranged or can be arranged, in particular so as to be evenly distributed in relation to one another, in an interior, in particular forming part of a passenger compartment 9, of the motor vehicle 2. An exemplary arrangement of corresponding detection elements 13*a*-13*c* provides detection elements 13*a*, 13*b* in the region of the driver and front passenger seats and at least one detection element 13*c* in the region of the back of the motor vehicle 2. Each of the detection elements 13*a*-13*c* can be designed as microphones or comprise such. The microphones are typically direction-independent microphones although direction-dependent microphones are also conceivable.

The control apparatus 7 is designed to control the operation of the signal-generating apparatus 6 on the basis of a piece of information generated by the determination apparatus 8. The signal-generating apparatus 6 is therefore operated, i.e. in particular corresponding compensation signals 3 are generated, with the proviso that signals 5 are compensated for when their propagation direction indicates that they originate from the region of the motor-vehicle drive unit 4, i.e. signals which are propagated starting from the motor-vehicle drive unit, and thus actually result from the operation of the motor-vehicle drive unit 4. Conversely, the signal-generating apparatus 6 is operated, i.e. in particular corresponding compensation signals are generated, with the proviso that signals 10 are not compensated for when their propagation direction indicates that they do not originate from the region of the motor-vehicle drive unit 4, i.e. which signals are not propagated starting from the motor-vehicle drive unit 4, and thus do not result from the operation of the motor-vehicle drive unit 4. In the embodiment shown in the drawing, such signals 10 are e.g. signals that result from the operation, in particular the operation of drive unit 11, of a further motor vehicle 12 in the surroundings around the motor vehicle 2.

The device 1 is therefore designed to determine whether or not an acoustic signal actually results from the operation of the motor-vehicle drive unit 4. Thus, the device 1 is designed to differentiate between signals which are relevant for their actual function, i.e. the compensation of signals 5 that result from the operation of the motor-vehicle drive unit 4, and signals which are not relevant for their actual function. The device 1 is operated, i.e. in particular compensation signals 3 are generated, on the basis of this decision such that only relevant signals 5 are compensated for. The device 1 is therefore sensitive to disturbances due to certain acoustic conditions or influences, e.g. acoustic influences of other road users, e.g. drive units 11 of other motor vehicles 12, acoustic influences when entering or driving through a tunnel, etc., and the connected generation of artifacts which may be audible to a vehicle occupant and may be perceived as disturbing.

The determination apparatus 8 is designed to determine signals 5 which have a first propagation direction that is relevant for the operation of the device 1 for generating compensation signals 3 and to generate a piece of first direction information describing the propagation direction of said signals 5. The operation of the signal-generating apparatus 6 can therefore be controlled on the basis of pieces of first direction information in order to compensate for signals 5 that actually result from the operation of the motor-vehicle drive unit 4. The signal-generating apparatus 6 is designed accordingly to compensate for determined signals 5 which have a propagation direction that is relevant for the operation of the device 1 for generating compensation signals 3.

The determination apparatus 8 is further designed to determine acoustic signals 10 which have a second propagation direction that is not relevant for the operation of the device 1 for generating acoustic compensation signals 3 and to generate a piece of second direction information describing the propagation direction of said signals 10. The operation of the signal-generating apparatus 6 is therefore controlled on the basis of pieces of second direction information, e.g. is changed, restricted or prevented so as not to compensate for any signals 5 that do not result from the operation of the motor-vehicle drive unit 4. The signal-generating apparatus 6 is designed accordingly to damp and/or filter determined signals which have a propagation direction that is not relevant for the operation of the device 1 for generating compensation signals 5.

The device 1 can further comprise a hardware- and/or software-implemented memory apparatus 14 which is associated with the control apparatus 7, is in the form of a data memory and in which a piece of first reference direction information describing the propagation direction of a signal 5 that results from the operation of the motor-vehicle drive unit 4 and a piece of second reference direction information describing the propagation direction of an acoustic signal 10 that does not result from the operation of the motor-vehicle drive unit 4 is stored. By providing a corresponding memory apparatus or pieces of reference direction information which are stored in a corresponding memory apparatus 14, a comparatively simple determination of signals 5 which have a relevant propagation direction for the operation of the device 1 for generating compensation signals 3 is possible by means of data-related adjusting or comparing pieces of determined direction information with corresponding reference direction information. Pieces of corresponding reference direction information can e.g. be generated in the context of a calibration of the device and correspondingly stored in the memory apparatus for the purpose of pieces of calibration information.

The control apparatus 7 is therefore designed to put the signal-generating apparatus 6 into operation when the direction information, in particular a comparison of the direction information with the reference direction information, describes a propagation direction of a signal 5 starting from the drive unit 4 or the region of the motor vehicle 2 that accommodates the drive unit 4, and is correspondingly designed to operate the signal-generating apparatus 6 such that a compensation signal 3 is generated only for such signals 5 for which a piece of associated direction information describes that said signals have a propagation direction starting from the motor-vehicle drive unit 4 or the region of the motor vehicle 2 that accommodates the drive unit 4, which compensation signal compensates for said signals 5.

Furthermore, the control apparatus 7 is designed to not put the signal-generating apparatus 6 into operation or to take said signal-generating apparatus out of operation or to put said signal-generating apparatus into operation using at least one other set of operating parameters when the direction information, in particular a comparison of the direction information with the reference direction information, describes a propagation direction of a signal 10 starting from a region other than the region of the motor vehicle 2 that accommodates the motor-vehicle drive unit 4. The control apparatus 7 is therefore designed to operate the signal-generating apparatus 7 such that a compensation signal 3 is not generated for such signals for which a piece of associated direction information describes that said signals do not have a propagation direction starting from the motor-vehicle drive unit 4 or the region of the motor vehicle 2 that accommodates the motor-vehicle drive unit 4, which compensation signal 3 compensates for said signals 10.

In other words, the control apparatus 7 is (therefore) designed to put the signal-generating apparatus 6 into operation such that an acoustic compensation signal 3 is not generated for such signals 5 for which a piece of associated direction information describes that said signals do not have a propagation direction starting from a motor-vehicle drive unit 4 or the region of the motor vehicle 2, which acoustic compensation signal compensates for said signals 10; thus such signals 10 can be ignored, in particular completely ignored.

A determination of the propagation direction of signals 5, 10 may also be understood to mean an in particular direct detection of the propagation direction of signals 5, 10 within the motor vehicle 2 equipped with the device 1, i.e. in particular within the passenger compartment 9 of the motor vehicle 2. In this case, the detection apparatus 13 can comprise a plurality of detection elements 13*a*-13*c* in the form of direction-dependent microphones. Typically, at least one microphone is arranged so as to be oriented such that said microphone detects signals that result from the operation of the motor-vehicle drive unit 4. A corresponding microphone can accordingly be arranged so as to be oriented (directly) opposite the drive unit 4.

The device 1 can be used to implement a method for operating a device 1 for generating compensation signals 3 which serve to compensate for signals 5 that result from the operation of a motor-vehicle drive unit 4. The method comprises the steps of:

detecting at least one signal 5, 10 within a motor vehicle 2, i.e. in particular within the passenger compartment 9 of a motor vehicle 2, determining the propagation direction of the at least one detected signal 5, 10, generating a piece of direction information describing the propagation direction of the at least one detected signal 5, 10, controlling the operation of the signal-generating apparatus 6 on the basis of the generated direction information.

The invention claimed is:

1. A device for generating acoustic compensation signals that serve to compensate for acoustic signals that result from the operation of a motor-vehicle drive unit, said device comprising:

a signal-generating apparatus that is designed to generate acoustic compensation signals that serve to compensate for acoustic signals that result from the operation of a motor-vehicle drive unit, a control apparatus that is associated with the signal-generating apparatus and that is designed to control the operation of the signal-generating apparatus, characterized by a determination apparatus that is associated with the control apparatus and that is designed to determine the propagation direction of acoustic signals and to generate a piece of direction information describing the determined propagation direction of the acoustic signals in question, the control apparatus being designed to control the operation of the signal-generating apparatus on the basis of a piece of corresponding direction information, wherein the device is configured to determine whether or not an acoustic signal actually results from the operation of the motor-vehicle drive unit by differentiating between signals that are relevant for their actual function, which are the compensation of signals that result from the operation of the motor-vehicle drive unit, and signals that are not relevant for their actual function.

2. The device according to claim 1, wherein the determination apparatus is designed to determine acoustic signals that have a first propagation direction that is relevant for the operation of the device for generating acoustic compensation signals that serve to compensate for acoustic signals that result from the operation of a motor-vehicle drive unit, and to generate a piece of first direction information describing the propagation direction of said signals, and in that the determination apparatus is designed to determine acoustic signals that have a second propagation direction that is not relevant for the operation of the device for generating acoustic compensation signals that serve to compensate for acoustic signals that result from the operation of a motor-vehicle drive unit, and to generate a piece of second direction information describing the propagation direction of said signals.

3. The device according to claim 2, wherein the control apparatus is designed to damp and/or to filter determined acoustic signals that have a piece of propagation information that is not relevant for the operation of the device for generating acoustic compensation signals, which serve to compensate for acoustic signals that result from the operation of a motor-vehicle drive unit.

4. The device according to claim 1, wherein a memory apparatus is provided in which a piece of reference direction information describing the propagation direction of an acoustic signal that results from the operation of a motor-vehicle drive unit, and/or a piece of reference direction information describing the propagation direction of an acoustic signal that does not result from the operation of a motor-vehicle drive unit, is stored.

5. The device according to claim 1, wherein the control apparatus is designed to put the signal-generating apparatus into operation when a comparison of the direction information with the direction information with the reference drive information describes a propagation direction of at least one acoustic signal starting from a drive unit or a region of a motor vehicle that accommodates a drive unit.

6. The device according to claim 1, wherein the control apparatus is designed to not put the signal-generating apparatus into operation or to take said signal-generating apparatus out of operation when a comparison of the direction information with the reference direction information describes a propagation direction of at least one acoustic signal starting from a region other than a region of a motor vehicle that accommodates a drive unit.

7. The device according to claim 1, wherein the control apparatus is designed to put the signal-generating apparatus into operation using at least one other set of operation parameters when a comparison of the direction information with the reference direction information describes a propagation direction of at least one acoustic signal starting from a region other than a region of a motor vehicle equipped with the device that accommodates a drive unit.

8. The device according to claim 1, wherein the control apparatus is designed to put the signal-generating apparatus into operation such that an acoustic compensation signal is generated only for such acoustic signals for which a piece of associated direction information describes that said signals have a propagation direction starting from a motor-vehicle drive unit or a region of a motor vehicle equipped with the device that accommodates a motor-vehicle drive unit, which acoustic compensation signal compensates for said signals.

9. The device according to claim 1, wherein the control apparatus is designed to put the signal-generating apparatus into operation such that an acoustic compensation signal is not generated for such acoustic signals for which a piece of associated direction information describes that said signals do not have a propagation direction starting from a motor-vehicle drive unit or a region of a motor vehicle equipped with the device that accommodates a motor-vehicle drive unit, which acoustic compensation signal compensates for said signals.

10. The device according claim 1, wherein a detection apparatus is associated with the control apparatus and is designed to detect acoustic signals that result from the operation of a motor-vehicle drive unit of a motor vehicle equipped with the device.

11. The device according to claim 10, wherein the control apparatus is designed to damp and/or filter detected acoustic signals that do not result from the operation of the motor-vehicle drive unit.

12. The device according to claim 10, wherein the detection apparatus comprises a plurality of detection elements that are arranged in an interior forming part of a passenger compartment of a motor vehicle equipped with the device.

13. The device according to claim 12, wherein the detection elements are designed as microphones or comprise such.

14. The device according to claim 1, wherein an acoustic signal that does not start from a motor-vehicle drive unit of a motor vehicle equipped with the device or a region of a motor vehicle equipped with the device that accommodates a motor-vehicle drive unit is generated by a signal source located outside of a motor vehicle equipped with the device.

15. A motor vehicle, comprising:

a device according to claim 1.

16. A method for operating a device for generating acoustic compensation signals that serve to compensate for acoustic signals that result from the operation of a motor-vehicle drive, said method comprising:

detecting at least one acoustic signal, determining the propagation direction of the at least one detected acoustic signal, generating a piece of direction information describing the propagation direction of the at least one detected acoustic signal, controlling the operation of the signal-generating apparatus on the basis of the generated direction information, the controlling including determining whether or not an acoustic signal actually results from the operation of the motor-vehicle drive, by differentiating between signals that are relevant for their actual function, which are the compensation of signals that result from the operation of the motor-vehicle drive, and signals which are not relevant for their actual function.

* * * * *